US006773216B2

(12) United States Patent
Crudo et al.

(10) Patent No.: US 6,773,216 B2
(45) Date of Patent: Aug. 10, 2004

(54) BINDING APPARATUS

(75) Inventors: Phillip Michael Crudo, Round Lake, IL (US); Samuel Paul Amdahl, Des Plaines, IL (US); Thomas Battisti, Buffalo Grove, IL (US); Wayne Howard Rothschild, Northbrook, IL (US)

(73) Assignee: General Binding Corporation, Northbrook, IL (US)

( * ) Notice: Subject to any disclaimer, the term of this patent is extended or adjusted under 35 U.S.C. 154(b) by 144 days.

(21) Appl. No.: 10/149,925

(22) PCT Filed: Dec. 15, 2000

(86) PCT No.: PCT/US00/34056

§ 371 (c)(1),
(2), (4) Date: Oct. 7, 2002

(87) PCT Pub. No.: WO01/43898

PCT Pub. Date: Jun. 21, 2001

(65) Prior Publication Data

US 2003/0206788 A1 Nov. 6, 2003

Related U.S. Application Data

(60) Provisional application No. 60/172,509, filed on Dec. 17, 1999.

(51) Int. Cl.[7] ..... B42B 5/10

(52) U.S. Cl. ..... 412/39; 140/92.3; 270/58.08; 412/9; 412/33; 412/38

(58) Field of Search ..... 412/9, 19, 20, 412/33, 38, 39, 40; 270/52.18, 58.08; 140/92.3

(56) References Cited

U.S. PATENT DOCUMENTS

| | | | |
|---|---|---|---|
| 3,595,183 | A | 7/1971 | Stoothoff |
| 3,616,074 | A | 10/1971 | Hoff et al. |
| 3,970,118 | A | 7/1976 | Varga |
| 4,358,042 | A | 11/1982 | Lawrence |
| 4,508,366 | A | 4/1985 | Brindle |
| 4,588,180 | A | 5/1986 | Ballestrazzi et al. |
| 4,611,520 | A | 9/1986 | Terracciano |
| 4,770,333 | A | 9/1988 | Weeks |
| 4,807,868 | A | 2/1989 | Hirst et al. |
| 4,832,370 | A | 5/1989 | Jones |
| 4,873,858 | A | 10/1989 | Jones |
| 4,874,279 | A | 10/1989 | Pfaffle |
| 4,875,355 | A | 10/1989 | Jones |
| 4,934,890 | A | 6/1990 | Flatt |
| 5,059,078 | A | 10/1991 | Schmid |
| 5,064,181 | A | 11/1991 | Hosoi et al. |
| 5,067,700 | A | 11/1991 | Dick |
| 5,324,154 | A | 6/1994 | Jones et al. |

(List continued on next page.)

FOREIGN PATENT DOCUMENTS

| | | | |
|---|---|---|---|
| EP | 0433585 | A2 | 6/1991 |
| EP | 0891878 | A2 | 1/1999 |
| GB | 2267460 | A | 12/1993 |
| GB | 2301553 | A | 12/1996 |
| GB | 2327204 | A | 1/1999 |

*Primary Examiner*—Monica S. Carter
(74) *Attorney, Agent, or Firm*—Leydig, Voit & Mayer, Ltd.

(57) ABSTRACT

A binding apparatus facilitates a convenient, one-stage load-and-close binding system. The apparatus has a base and a pivotable former door movable between open and closed positions. A series of hooks are provided to hold an open binder relative to the base for loading sheets onto the open binder ringlets. The apparatus has three former surfaces or bars, including parallel, opposed first and second former bars, as well as an adjacently-positioned third former bar oriented generally perpendicularly to the first and second former bars. Generally, the binding apparatus operates to squeeze a wire binder between the opposed first and second forming bars to close the wire ringlets. The free ends of the wire ringlets are maintained in proper alignment against the third former bar.

39 Claims, 8 Drawing Sheets

U.S. PATENT DOCUMENTS 5,370,489 A 12/1994 Bagrosky
5,461,219 A 10/1995 Cronvall
5,527,141 A 6/1996 Malmstrom
5,549,433 A 8/1996 Byrne
5,615,986 A 4/1997 Cox
5,837,344 A 11/1998 Braun
5,855,464 A 1/1999 Bennett
5,890,862 A 4/1999 Spiel et al.
5,934,340 A 8/1999 Anthony et al.
6,000,897 A 12/1999 DesJarlais
6,062,792 A 5/2000 Garrity
2003/0206788 A1 * 11/2003 Crudo et al. ..... 412/39

* cited by examiner 10
16
110
18
14
60
60
48
12
14

18
32
26
22
28
34
10
30
24
40
42
70
31
43
17
43a
72
44
16
33
52a
12
52
20
14
46
21

BINDING APPARATUS

FIELD OF THE INVENTION

The present invention generally relates to machines for binding together stacks of perforated paper sheets, and more particularly, relates to a binding apparatus for forming a wire binder.

BACKGROUND OF THE INVENTION

Books, papers and documents are often bound by a wire comb binder which includes a row of ringlets. Initially, the ringlets have open ends to permit the insertion of perforated pages onto the binder. By use of a binding apparatus, the wire comb binder is squeezed, plastically deforming to close the ringlets. Various binding machines are known for formably closing the binder. For example, U.K. Patent Application GB 2 327 204 A, which claims priority on GB 9712718, incorporated herein by reference, discloses a binding apparatus in which first and second, planar, opposed forming surfaces for closing a wire binder therebetween. The binding apparatus has a plurality of hooks to hold the wire comb binder between the two opposed forming surfaces. Initially, the wire comb binder is hung from the hooks in an open condition so that the open ringlets of the wire comb binder are positioned to receive a stack of perforated sheets. The opposed pair of forming surfaces are then moved toward each other, squeezing the binder to close the wire ringlets.

Various problems exist with such known binding mechanisms. For example, the wire ringlets can become misaligned because free ends of the wire binder are unguided during the operation of deflectably closing the wire ringlets.

Other known binding systems required a two-stage process wherein the perforated sheets are inserted onto binder ringlets at a first stage, then the binder is moved to a second stage for a closing operation. This two-stage process is inconvenient as well as time consuming.

SUMMARY OF THE INVENTION

The present invention provides an improved binding apparatus for forming a wire binder. In an embodiment, the binding apparatus has a base and a pivotable former door movable between open and closed positions. The apparatus has three forming surfaces or former bars, including parallel, opposed first and second former bars, as well as an adjacently-positioned third former bar oriented generally perpendicularly to the first and second former bars. For the purposes of this disclosure, the terms "former bar" and "former surface" are used interchangeably. Generally, the apparatus is operable to squeeze a wire binder between the opposed first and second forming bars to close the wire ringlets, as a spine ends and free ends of the wire ringlets guidably slide against the perpendicular third former bar.

Advantageously, the invention provides a binding apparatus configuration which facilitates loading of the open binder at the same place at which the closing operation occurs. Particularly, in the preferred embodiment, the second and third former bars are mounted to a pivotably mounted former door. For convenient loading of the wire binder and sheets without interference by the second and third former bars, the former door is pivoted to the open position. When the door is open, a plurality of hooks is accessible for initially supporting the wire binder in a held position. The hooks are mounted to the base of the binding apparatus adjacently above the first former bar so that the binder is supported against the adjacent first former bar while hanging from the hooks. The wire binder (in an "open" condition) is hung on the hooks, positioning the free ends of the ringlets to receive a stack of perforated sheets.

When the wire binder has been loaded with a desired stack of sheets to be bound, the door is moved to a closed position, positioning the wire binder within a space between the first and second former bars with the free ends of the wire binder in contact against the third former bar. From this position, the first and second former bars are movable relative to each other to squeeze the binder closed. The third former surface or bar of the binding apparatus according to the present invention serves to guide the ends of each wire ringlet during the squeezing of the wire binder between the first and second former bars. This causes the wire binder to plastically close such that the proximal and distal ends of each ringlet reliably meet.

In a first embodiment, the first former bar is movably mounted relative to the base on a cam-actuated slider mechanism. This bends the wire binder to a "closed" condition, the spine ends and free ends of the wire ringlets guidably sliding along the third former bar. In an embodiment, the second and third former bars remain fixed during the closing motion of the first former bar. Alternate embodiments are also possible wherein the second former bar is movable toward the first former bar during the closing operation. For example, the binding apparatus may include a linkage for driving both the first and second former bars toward each other.

An advantage of the present invention is that it is, at least partially, self-adjusting, avoiding a need to adjust the orientation of the wire binder element as is required in some known binding machines. More particularly, as the door is closed, the third former bar contacts the wire binder element and causes it to "roll" along the first former bar until the door is fully closed. At this point, both the spine ends and free ends of the wire ringlets contact the third former bar, optimally positioning the binder element for the closing operation. This advantageously avoids a need to adjust the hooks of a known binding machine in order to properly position the wire binder element between former bars for closing.

For adjusting the binding apparatus to accommodate wire binders of different sizes, in an embodiment, the pivot point of the door is linearly adjustable. More specifically, the door hinges on a pair of pivots which reside in respective slots. An adjusting mechanism positions the door at a selected position. In the embodiment wherein the second and third former bars are fixedly mounted to the door and the first former bar is movably mounted to the base, the present invention provides a simple and efficient assembly of components. Specifically, the movable-door arrangement permits the movable first former to be operated by a simple mechanism, such as a cam mechanism, which displaces the first former bar by a predetermined distance regardless of binder size. The adjustable position of the door permits a full range of adjustability for closing different sized binders with the displaceable first former bar.

In accordance with teachings of the invention, the hooks are preferably movable against a spring bias, allowing the hooks to pivot under the weight of the stack of sheets received thereon and to accommodate the motion of the wire binder when the closure door is moved to the closed position against the wire binder. More specifically, when the door is closed, the hooks urge the wire binder element so that the spine ends and free ends of the wire binder lie against the third closure bar in proper alignment for squeezing between the first and second former bars. A locking mechanism may optionally be provided to lock the hooks into a predetermined position while the door is open. Closing the door actuates a release of the locking mechanism to release the hooks. This locking feature advantageously holds the hooks for convenient loading of paper sheets, then permits biased movement of the binder to maintain proper orientation during the closing of the former bars. For example, the locking mechanism may include a magnet mounted to the sliding plate on which the hooks are mounted, magnetically holding the plate in the predetermined position until the magnetic force is overcome. Alternatively, the locking mechanism may include a physical latching structure, such as an movable pin, that mechanically engages to hold the pins in the predetermined position.

Some prior art binding system required a two-stage operation. At a first stage, the binding element was held to permit loading of the sheets onto an open binding element. The open binding element with the inserted sheets were then moved to a second stage wherein a closing operation resulted in closing the binding element. An advantage of the present invention is to provide a binding apparatus which, in one stage, facilitates both: (a) the loading of sheets onto ringlets of a binder; and (b) the closing of the binder. This one-stage operation avoids a need to move the binder between loading and closing steps, greatly improving convenience to the user. More specifically, the binding apparatus of the invention is operable to hold the binder in one held position for both loading and closing the binder An additional advantage of the present invention is the provision of a binding apparatus that properly orients a wire binder element between opposing and perpendicular former bars prior to squeezing the binder closed.

Another advantage of the present invention is the provision of a binding apparatus that maintains the proper orientation of the wire binder element during the closing operation wherein the binder element is bent closed.

A further advantage of the present invention is the provision of a binding apparatus that guides ends of the wire ringlets during a closure of the wire binder.

Yet another advantage of the present invention is the provision of a binding apparatus that is fully adjustable to accommodate different sizes of wire binders, but which is simple, reliable and requires few parts.

Additional features and advantages of the present invention are described in, and will be apparent from, the detailed description of the presently preferred embodiments, the drawings and the claims.

BRIEF DESCRIPTION OF THE DRAWINGS

FIG. 2 is a schematic, sectional, side view of the binding apparatus of FIG. 1 in an initial position, wherein the movable former door is pivoted to an open position, and wherein an open wire binder element has been hung upon the hooks and loaded with a stack of perforated sheets.

FIG. 3 is a schematic, fragmentary, sectional, side view of the binding apparatus of FIG. 1, wherein the movable former door is partially closed, at a point where the distal end of the open wire binder element is initially contacted by the third former surface.

FIG. 4 is a schematic, fragmentary, sectional, side view of the binding apparatus of FIG. 1, wherein the former door has been closed, the proximal and distal ends of the wire binder, each contacting the third former surface.

FIG. 5 is a schematic, fragmentary, sectional, side view of the binding apparatus of FIG. 1, wherein the movable former bar has been extended to plastically close the wire binder.

DETAILED DESCRIPTION OF THE PRESENTLY PREFERRED EMBODIMENTS

Figure 1:
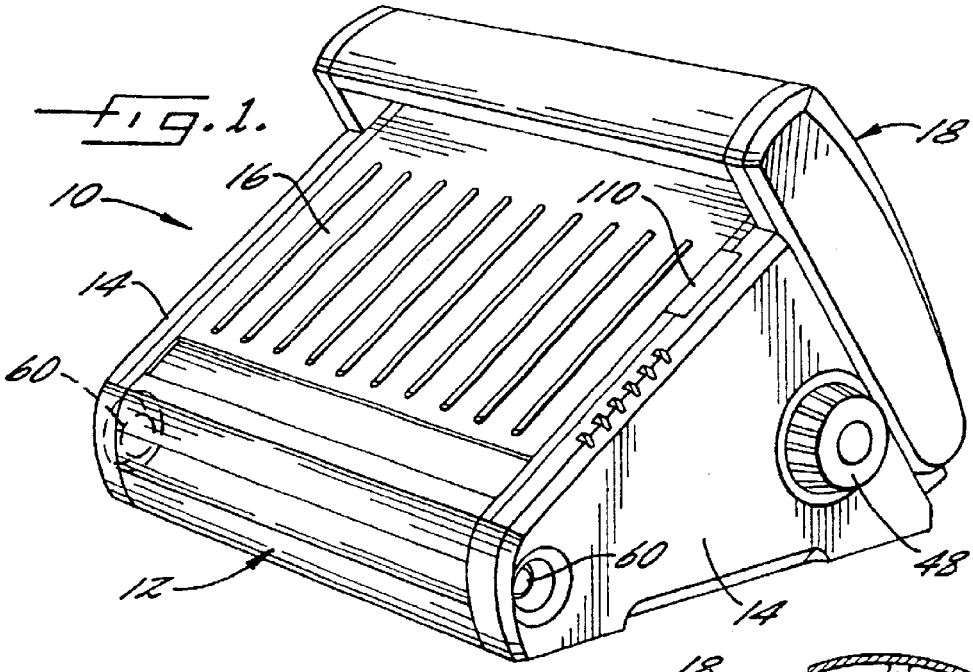
FIG. 1 is a perspective view of a binding apparatus constructed in accordance with teachings of the invention, wherein the movable former door is in a closed position.
Figure 2:
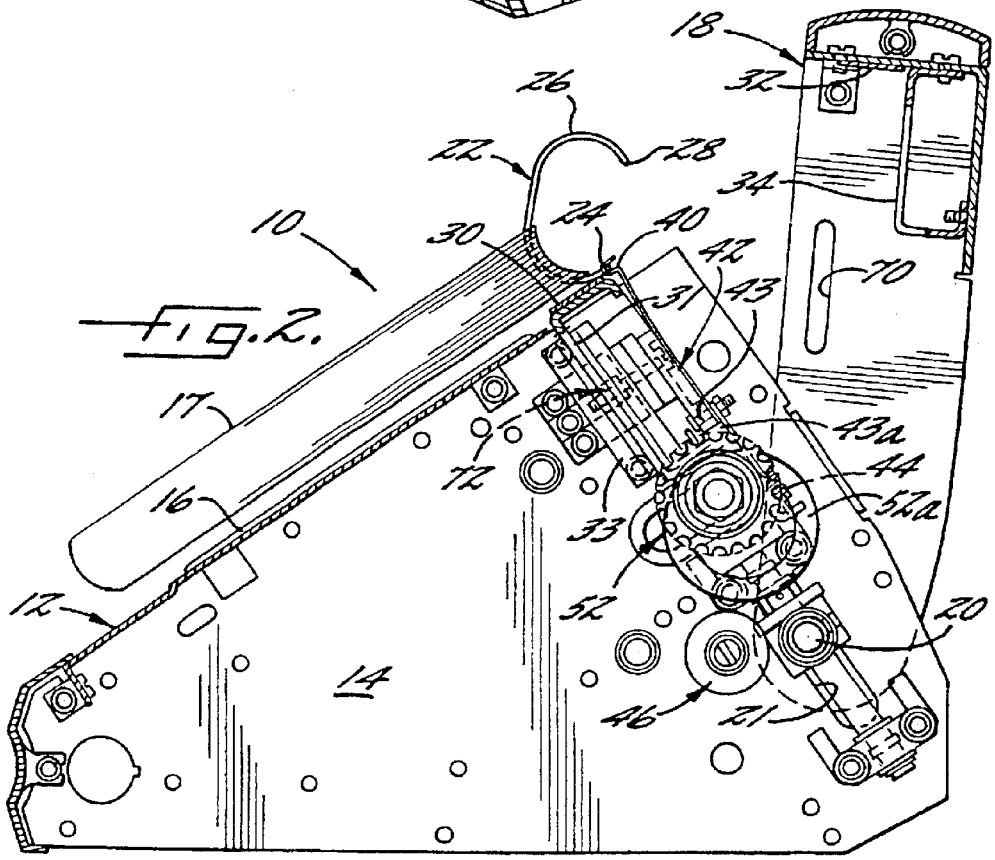
FIGS. 2–5 illustrate various sequential stages of operation of the binding apparatus of FIG. 1.
Figure 3:
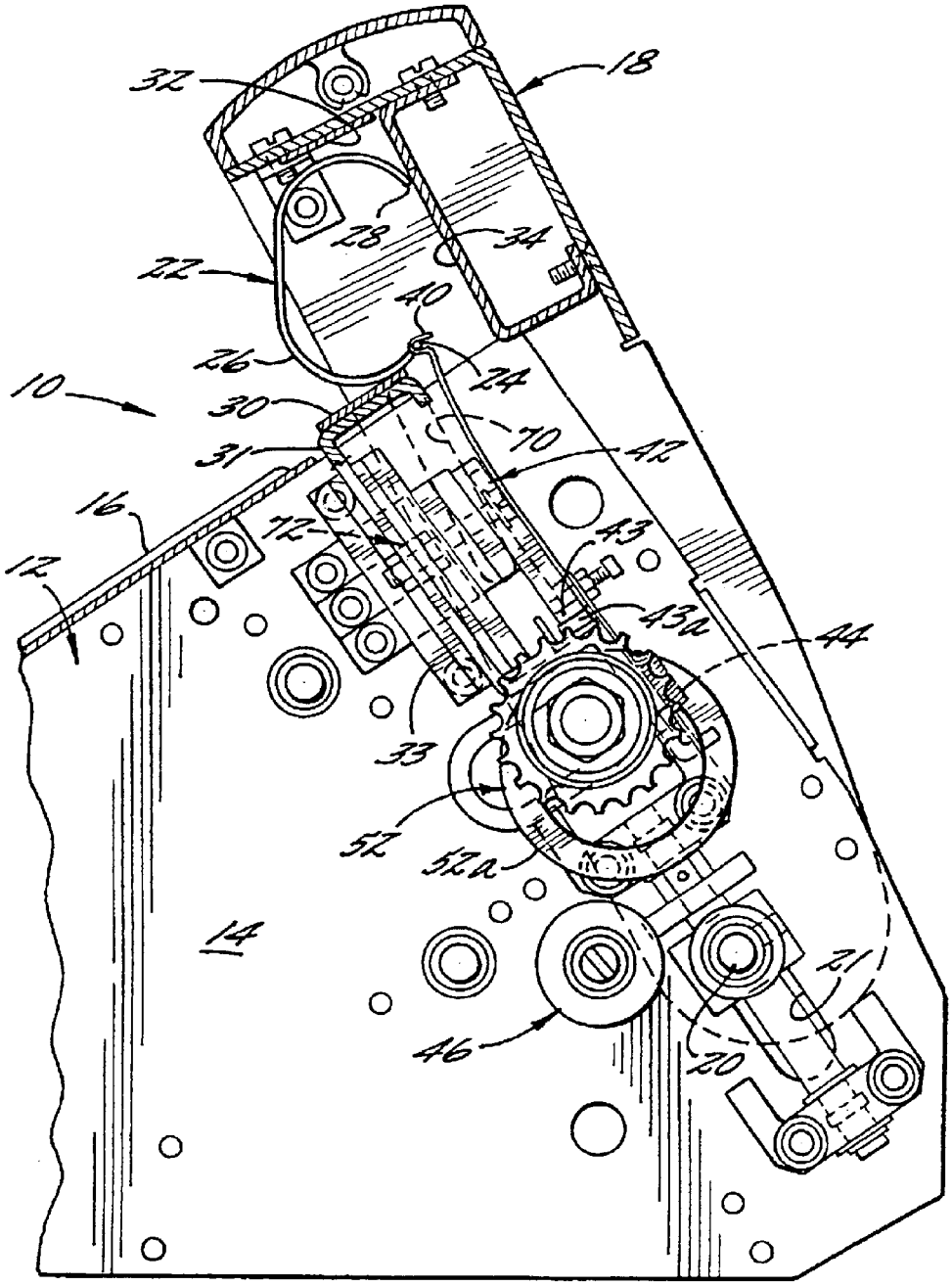
Figure 4:
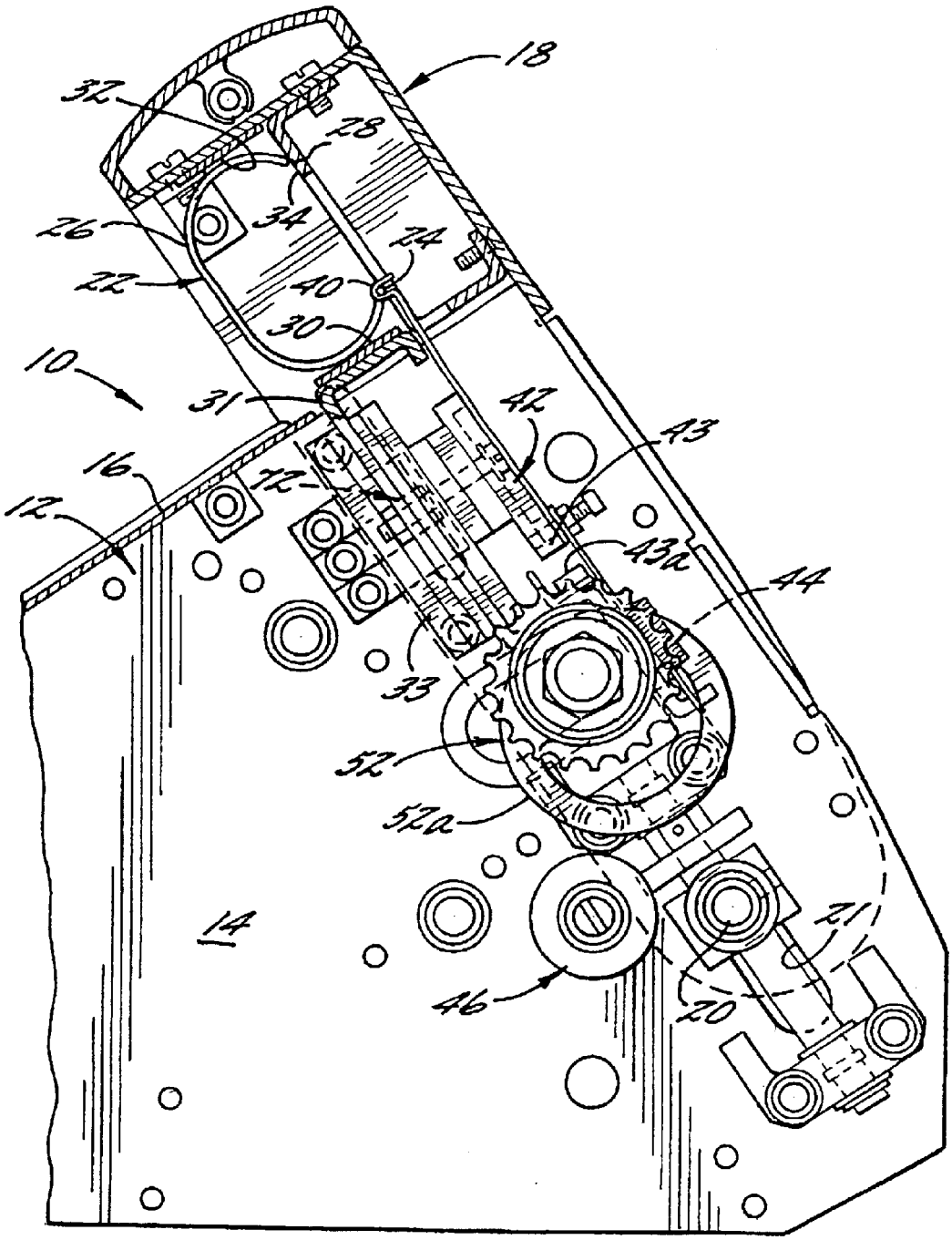
Figure 5:
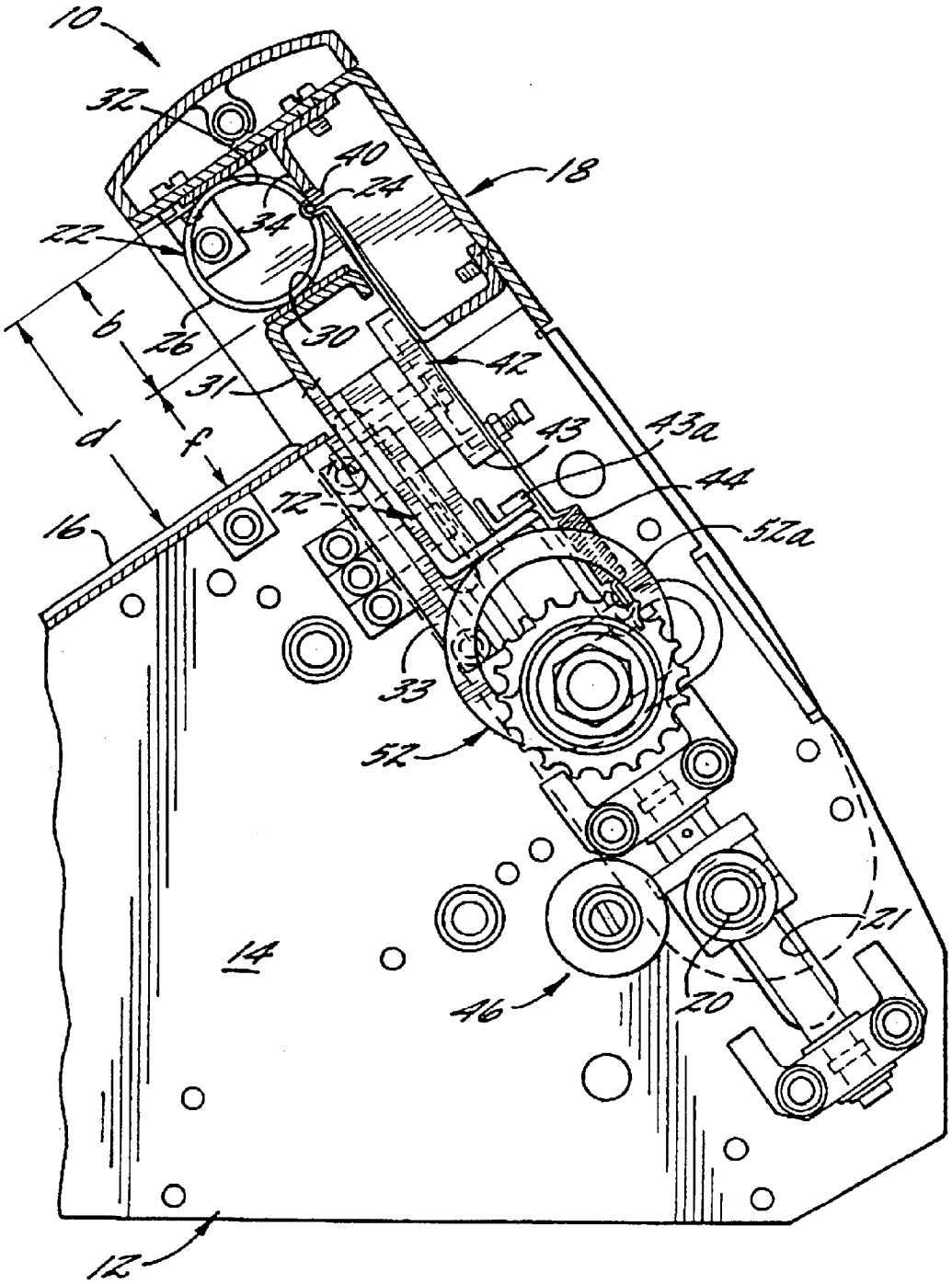

Referring now to the drawings, wherein like numerals designate like components, FIGS. 1–10 illustrate a binding apparatus 10 constructed in accordance with teachings of the present invention. As illustrated in FIG. 1, the binding apparatus 10 has a generally wedge-shaped base 12. The base 12 includes a pair of generally triangular side panels 14 and a generally planar sheet-support surface 16 extending between the side panels 14. The sheet support surface 16 is positioned for accessibility, sloping downwardly toward a front of the binding apparatus 10. Also, a former door 18 is pivotably mounted to a rear part of the base 12. The door 18 is pivotably mounted relative to the base 12. The door 18 is manually movable between a closed position, as illustrated in FIGS. 1, 4 and 5, and an open position, as illustrated in FIG. 2.

As described in greater detail below, when the door 18 is in the open position, the binding apparatus 10 is ready to be loaded with a wire comb binder and a stack 17 (FIG. 2) of perforated sheets to be bound. When the door 18 is closed, the binding apparatus 10 can execute an operation for bending the wire comb binder to a "closed" condition for binding the stack 17 of sheets.

Turning to FIGS. 2–5, the binding apparatus 10 is illustrated in greater detail. In general, the binding apparatus 10 is operable to hold and bend a wire comb binder 22. The wire binder 22 is generally known, being formed of a wire to define a plurality of curved ringlets 26. Each of the ringlets 26 has a spine end 24 at which adjacent ringlets 26 are connected. Distally relative to the spine end 24, each of the ringlets 26 has a free end 28.

For acting upon the binder 22, the binding apparatus 10 includes first, second and third former bars 30, 32 and 34. Each of the former bars 30, 32 and 34 is generally planar and extends substantially along a width of the sheet support surface 16. In particular, the first former bar 30 is mounted to extend along an upper portion of the sheet support surface. The first former bar 30 is substantially parallel to the sheet support surface 16. In the initial position, shown in FIG. 2, the first former bar 30 lies substantially flush with the sheet supporting surface 16.

The second and third former bars 32, 34 are each mounted to an interior of the door 18 perpendicularly relative to each other. Referring to FIG. 4, when the door 18 is closed, the second former bar 32 is arranged to be aligned generally parallel to the first former bar 30, and spaced therefrom sufficiently to accommodate an open wire binder 22. Additionally, when the door 18 is in the closed position shown in FIG. 4, the third former bar 34 is positioned adjacently along the first and second former bars 30, 32, extending generally perpendicularly therebetween. The first former bar 30 may be, in an embodiment, magnetic. The magnetization helps keep the binder 22 in a desired position.

For closing the wire binder 22, the first former bar 30 is actuatably movable between the initial position illustrated in FIG. 2 and an extended position, as illustrated in FIG. 5. Specifically, in the embodiment illustrated in FIGS. 2–5, the first former bar 30 is mounted to a carriage 31, which is slidably mounted within the base 12. An actuating mechanism 52 is operable to move the carriage 31. In an embodiment, the actuating mechanism 52 may include a rotatable cam 52*a*, eccentric or gear linkage operable to drive the first former bar 30 toward the second former bar 32, although, alternately the mechanism may be actuated either manually, by a motor, a solenoid, or some other known actuator. In an embodiment, the actuating mechanism 52 is operable to displace the first former bar 30 by a predetermined distance f, as indicated in FIG. 5.

FIGS. 2–5 illustrate sequential stages of operation of the binding apparatus 10. In order to support a wire binder for receiving a stack of sheets, the binding apparatus 10 includes a row of hooks 40 positioned adjacently along an upper side of the movable first former bar 30. Each of the hooks 40 is configured to extend around a diameter of the wire of the wire binder 22. Initially, a user of the binding apparatus 10 hangs the spine ends 24 of an open wire binder 22 on the hooks 40, as illustrated in FIG. 2. Due to the sloped configuration of the first former bar 30, the wire binder 22 hangs on the hooks 22 in contact against the first former bar 30. Preferably, the first former bar 30 is magnetic to further hold the wire binder 22, which is typically made of an alloy containing iron. At this stage, the user can insert perforated sheets in a generally known manner over free ends 28 of the wire ringlets 26. These inserted sheets lie against the sloped sheet support surface 16.

Each of the hooks 40 is made of spring steel, or some other resilient material, so that the hooks 40 can resiliently deflect. Additionally, each of the hooks 40 is mounted on a plate 42 which is slidably mounted to the carriage 31 for movement in a direction perpendicular to the first former bar 30. Tension springs 44 have a first end secured to the plate 42 and second end secured to the carriage 31. The springs 44 urge the plate 42 and the associated hooks 40 toward the first former bar 30.

To bind various sized stacks of sheets, binders are conventionally provided in various pitches. For example, binders are commonly available in "2-to-1" size having two ringlets per inch and "3-to-1" having three ringlets per inch, and other sizes are also available. Known binding systems have utilized a system of interchangeable hooks to accommodate multiple hook pitches. However, in the preferred embodiment, the present invention advantageously avoids a need for interchanging the hooks 40 by spacing the hooks 40 at a 1-to-1 ratio of one hook per inch capable of universally holding most common sizes of commercial binders. If, however, a need arises for using hooks of a different pitch, sets of hooks 40 are provided in various pitches and are user-interchangeable.

When the desired sheets to be bound have been inserted onto the wire binder element 22, the door 18 is then moved toward a closed position. FIG. 3 illustrates the door 18 in a partially closed position, wherein the third former bar 34 contacts the open free ends 28 of the wire ringlets 26. Now turning to FIG. 4, wherein the door 18 has been moved to a fully closed position, it is seen that the third former bar 34 pushes the wire binder 22 to roll downwardly against the first former bar 30 until both the spine ends 24 and free ends 28 of the open wire ringlets 26 contact the third former bar 34. This places the binder 22 in an optimal orientation for closing between the first and second former bars 30 and 32.

In order to accommodate the hooks 40 when the door 18 is closed, the third former bar 34 has a plurality of slots 50. It will be appreciated by those of skill in the art that the free ends 28 of the wire ringlets 26 slide along the surface of the third former bar 30 during closing of the door 18 and during the binding process inasmuch as it is the spine ends 24 on the hooks 40 which space the wire ringlets 26 apart.

To ease the process of loading of sheets for binding, it is desirable to firmly hold the hooks 40 in a predetermined position for initially sheet loading while the door 18 is open, and then release the hooks 40 from the predetermined position to permit biased motion of the binder during the closing process. As illustrated in FIG. 2, the binding apparatus 10 includes one or more magnets 43 mounted to the plate 42 to hold the plate 42 in a predetermined position. More specifically, as illustrated in FIG. 2, when the door is open and the plate 42 is urged into a retracted position by the springs 44, the magnet 43 in attracted contact against a fixed metal component 43*a*. When a predetermined amount of force is exerted on the hooks 40, such as by closing the door 18 against the binder 22, the force of the magnet 43 is overcome, permitting biased movement of the hooks 40. In an alternate embodiment, a locking mechanism is optionally provided to physically lock the hooks 40 into the predetermined position while the door is open. Closing the door actuates a release of the locking mechanism to release the hooks. This locking feature advantageously holds the hooks for convenient loading of paper sheets, then permits biased movement of the binder to maintain proper orientation during the closing of the former bars.

According to another aspect of the invention, when the first former bar 30 is extended, the spine ends 24 and free ends 28 of the wire ringlets 26 are guided along the generally planar surface of the third former bar 34 as the ringlets 26 bend inwardly between the first and second former bars 30, 32. This guided contact of the binder 22 against the third former bar 34 helps assure that the free ends 28 and spine ends 24 are near each other when the binder 22 reaches its closed condition. Furthermore, the guided contact of the binder 22 against the third former bar 34 maintains a proper orientation of the binder 22.

Preferably, the binding apparatus has safety features to reduce risk of injury to a user from the actuated movement of the first former bar 30. In a preferred embodiment, the binding apparatus 10 includes a two actuator buttons 60 (FIG. 1). The buttons 60 are mounted at recessed portions of the base 12, and the buttons 60 are located at opposite sides from each other. Both of the buttons 60 must be pushed and held in order to actuate the closing operation, or in particular, to extend the first former bar 30. This assures that both of a user's hands are occupied and kept safely away from the former bar 30. If one or both of the buttons 60 is released during the closing operation, a controller causes the first former bar 30 to automatically stop extending and to begin retracting.

Figure 6:
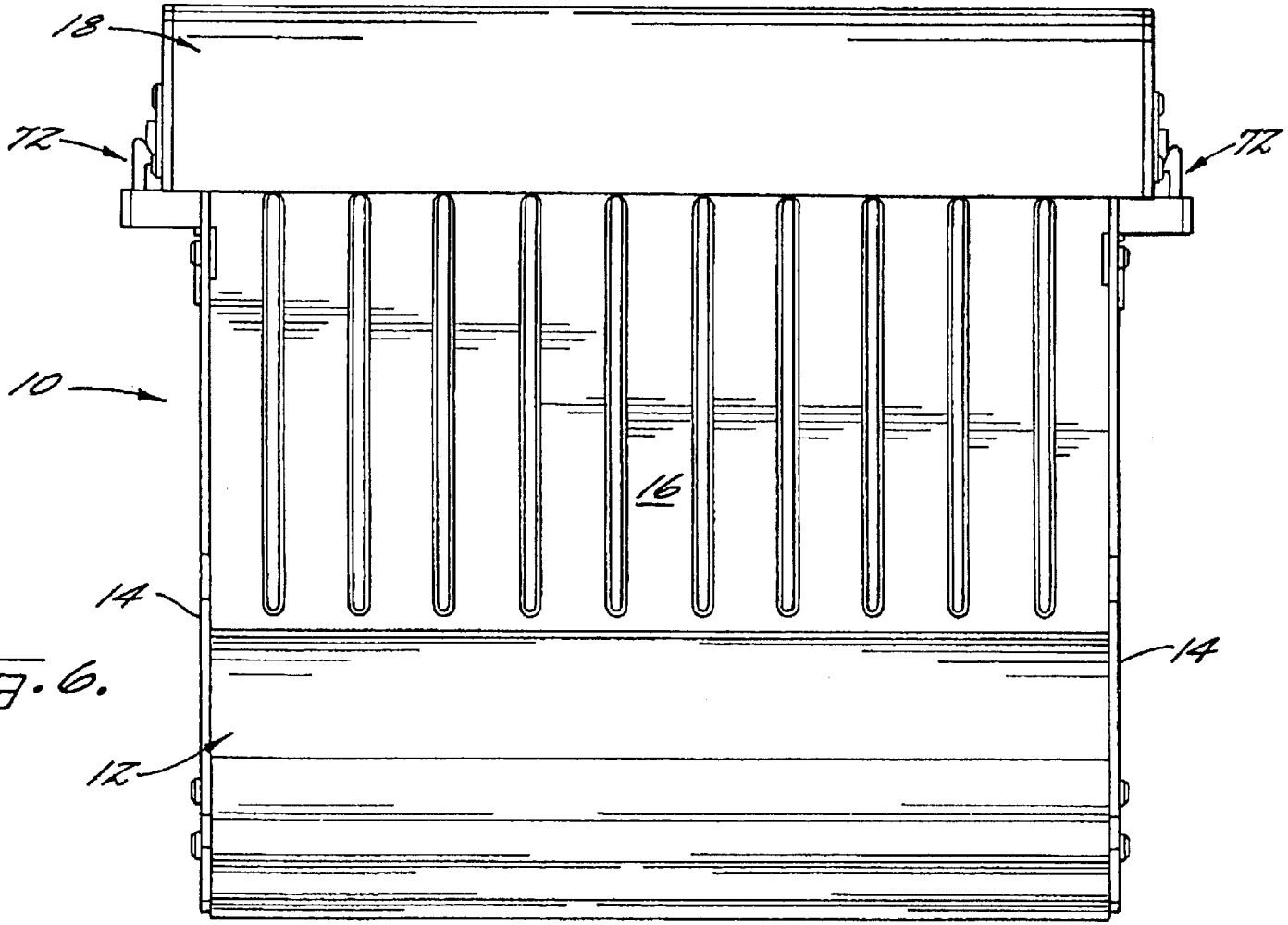
FIG. 6 is a view of an embodiment of the binding apparatus as looking generally downwardly and perpendicularly to the sheet-support surface, side covers being removed from the apparatus to illustrate the doorlock mechanism including latches engaging in slots within side panels of the door.
Figure 7:
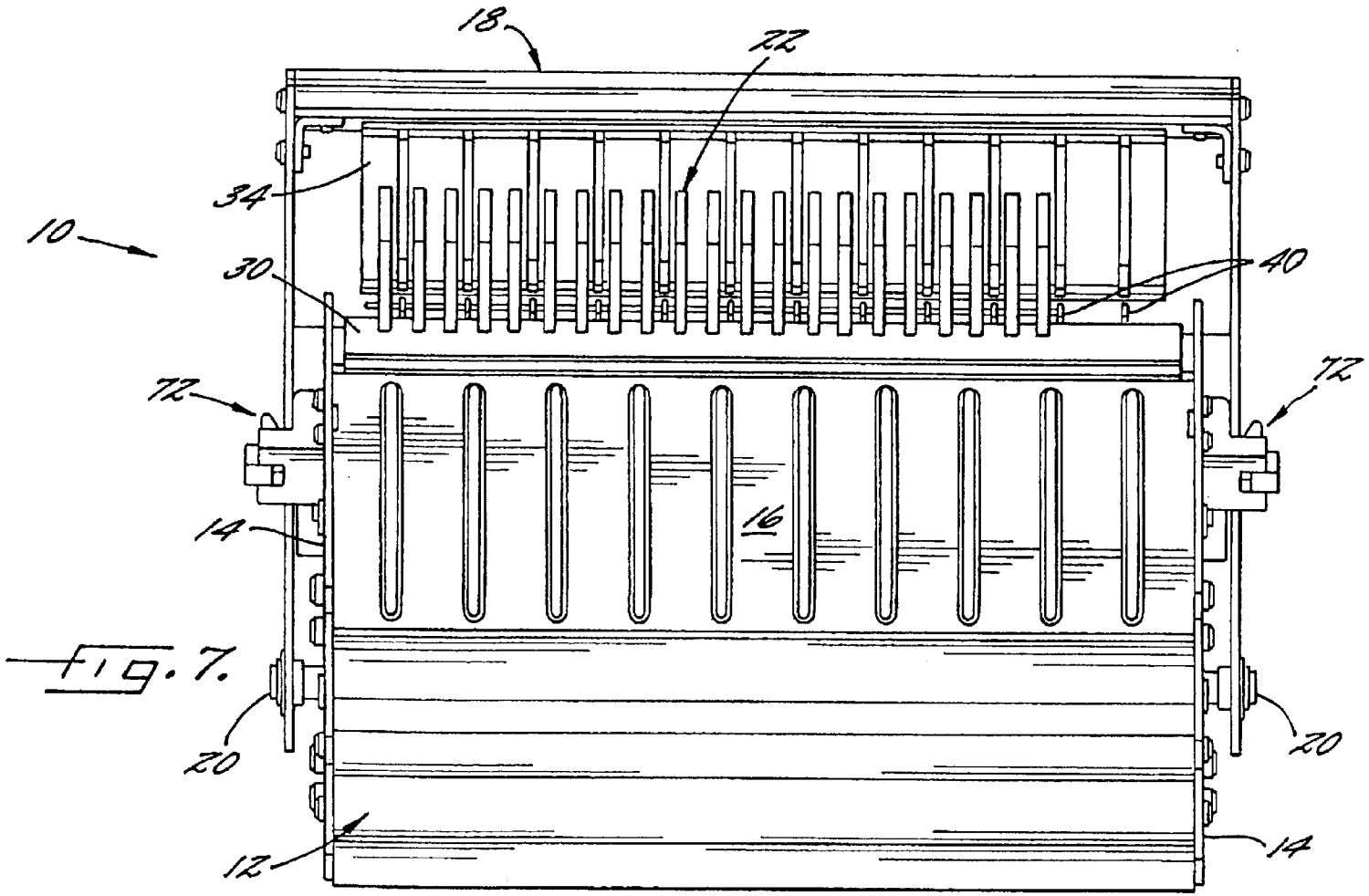
FIG. 7 is a front elevational view of the binding apparatus of FIG. 6, an open wire binder placed on the hooks of the binding apparatus.
Figure 8:
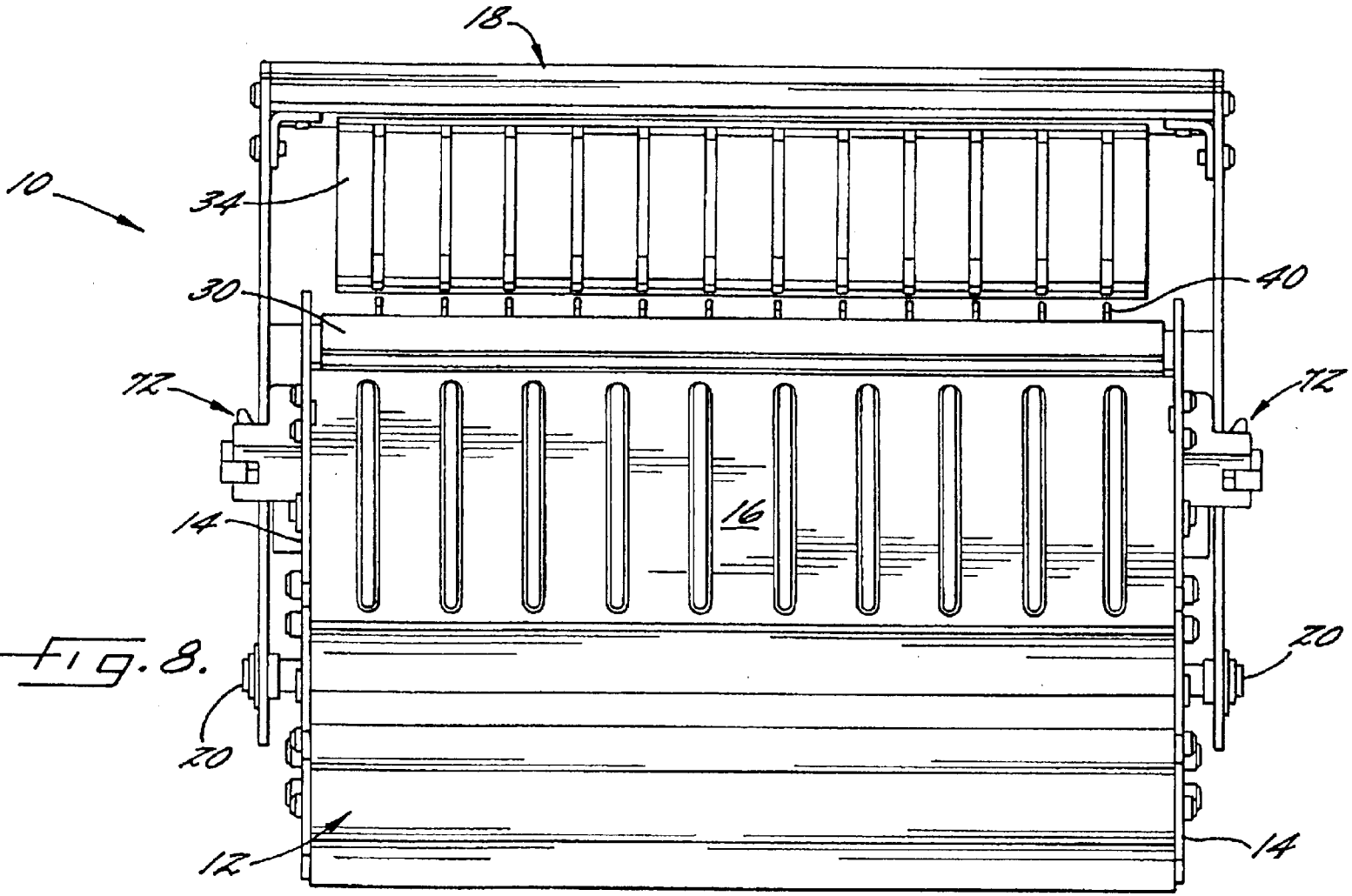
FIG. 8 is a front elevational view of the binding apparatus of FIG. 7. without the wire binder.

As an additional safety and reliability feature, in an embodiment, the binding apparatus 10 includes a doorlock device which secures the door 18 in the closed position (FIGS. 4, 5, 9 and 10) during the closing operation. In particular, a pair of slots 70 (FIGS. 9 and 10) are disposed within side panels of the door 18. A pair of extendible latches 72, as illustrated in FIGS. 6–8, are movably mounted to the base 12 for actuatable movement driven by the actuating mechanism 52. The latches 72 are slidably extendible from sides of the base 12 to engage within the respective slots 70 upon actuation of the first former bar 30, the latches 72 safely locking the door 18 in the closed position. The shape of the slots 70 allows locking of the door 18 at any linearly adjusted door position for a particular binder diameter. The latches 72 retract from the slots 70 upon completion of the closing cycle so that the door 18 can be opened for removal of the closed binder and sheets. By keeping the door 18 closed during closing of the binder 22, the latches 72 assure that the former bars 30, 32, 34 maintain the desired contact orientation upon the binder 22, and keeping the door 18 from inadvertently popping open during the closing process.

FIG. 5 illustrates the first former bar 30 in an extended position, at which point the first former bar 30 has filly displaced the distance f. In this extended position, the wire binder 22 has plastically deformed to a closed condition, wherein the free ends 28 of the ringlets 26 substantially meet or overlap the spine ends 24.

In order to maintain support of the binder 22 during the closing process in the illustrated embodiment, the hooks 40 engaged on the binder 22 are likewise displaced as the door 18 is closed and as the first former bar 30 advances. More particularly, the spine ends 24 of the binder 22 accelerate away from the first former bar 30 due to the curvature of the ringlets 26. Comparing the respective position of the hooks 40 in FIGS. 3 and 4, it can be seen that the spine ends 24 move away from the first former bar 30 as the door 18 is closed due to a rolling motion of the binder 22 on the first former bar 30. The hooks 40 remain engaged to the respective spine ends 24, causing the plate 42 to slide relative to the carriage 31 against the tension of the springs 44. Similarly, the spine ends 24 arc further away from the first former bar 30 when the binder 22 is deformably closed, as can be seen by a comparison between FIGS. 4 and 5. The plate 42 accordingly moves, against the bias of the springs 44, so that the hooks 40 may remain engaged on the respective spine ends 24 during the closing process. Additionally, the hooks 40 resiliently deflect as necessary to accommodate movement of spine ends 24.

In addition to the various pitch sizes, mentioned above, binders 22 are also available in a variety of ringlet diameters in order to facilitate binding of stacks of different thicknesses. To permit use of the binding apparatus 10 with a variety of binder sizes, the door 18, and the second former bar 32 fixed thereto, is linearly adjustable to vary the initial spacing between the first and second former bars. More specifically, the door 18 is mounted on a pair of pivots 20 rotatably disposed in respective slots 21, so that the position of the door 18 can be adjusted by changing the position of the pivots 20 within the slots 21. The binding apparatus 10 includes an adjustment mechanism 46 operable to vary the position of the pivots 20 by turning a knob 48 (FIG. 1) located at a side of the base.

To properly set the binding apparatus 10 for a given binder size, a user sets the pivot position of the door 18 prior to closing the door 18 and prior to the closing operation. As a result of adjusting the position of the door 18, the second former bar 32 can be positioned at a selected distance d, as indicated in FIG. 5, as measured from the sheet-support surface 16. The distance d corresponds to a distance b (d−f=b) between the first and second former bars 30, 32 when the first former bar 30 has extended the distance f. In other words, the position of the door 18 relative to the base is adjusted so that the distance b is sufficient to plastically close the wire ringlets 26 to a point wherein the spine ends 24 and distal ends 28 have substantially met or slightly overlapped.

Figure 9:
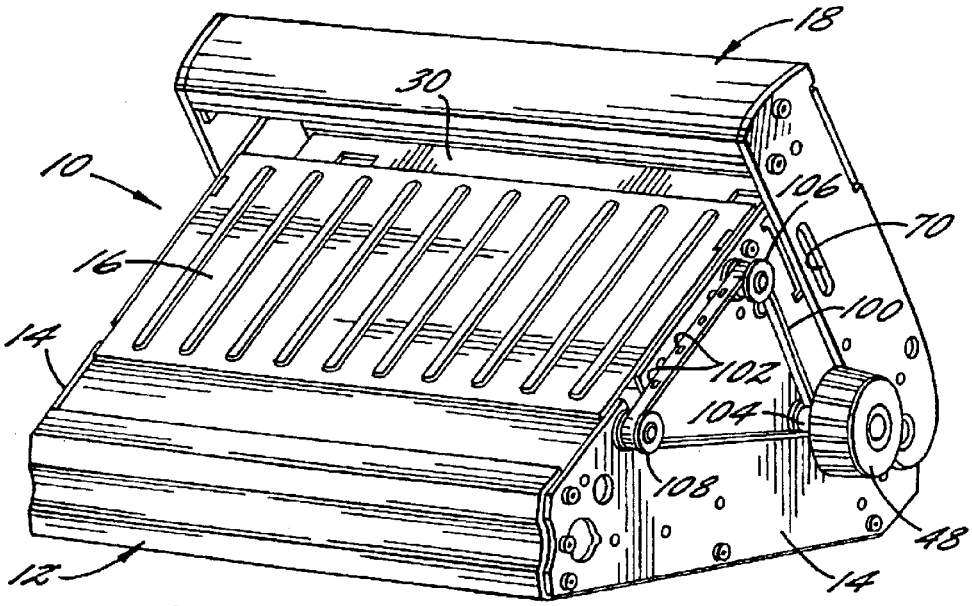
FIG. 9 is a perspective view of the binding apparatus of accordance having a side cover removed to show the indexing system.
Figure 10:
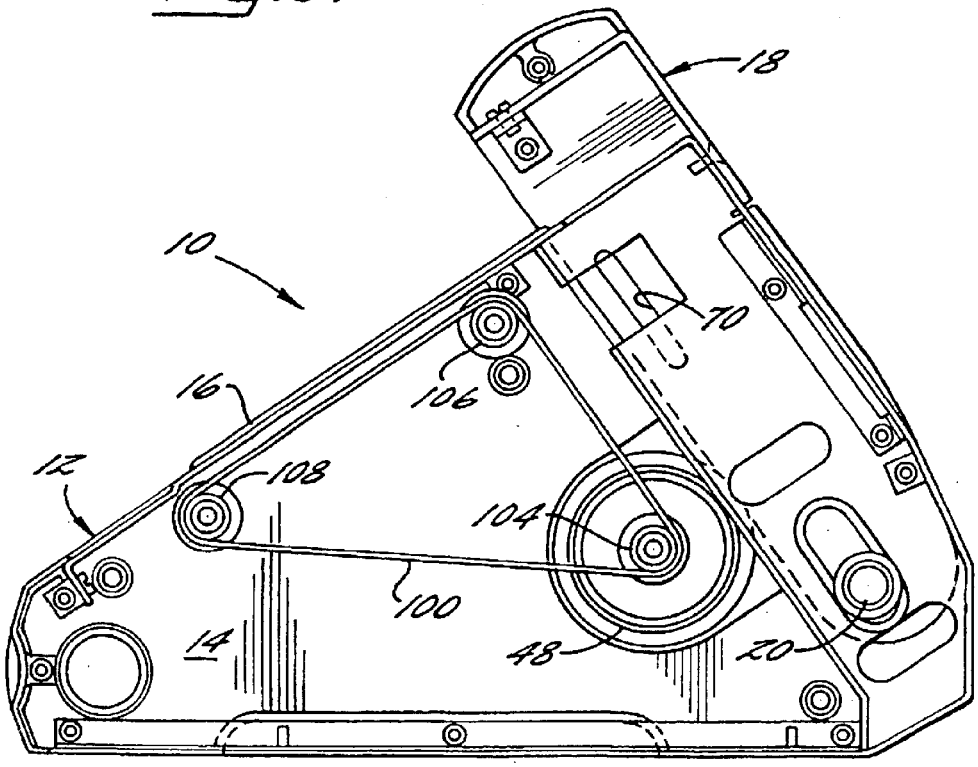
FIG. 10 is a schematic, side elevation of the binding apparatus illustrating the indexing system.

Referring to FIGS. 9 and 10, to allow convenient adjustment of the binding apparatus 10 for a particular binder size, in the embodiment illustrated, a viewable indexing system is provided. Specifically, a flexible belt 100 is provided which is printed with labels 102 at appropriately spaced intervals. Each of the labels 102 corresponds to a particular size of binder ringlet diameter. A drive pulley 104 is fixed to the knob 48 for rotatable movement therewith, and a pair of freely rotating idler pulleys 106, 108 are rotatably mounted to the base 12, spaced from each other. The belt 100 extends, in tension, around the pulleys 104, 106 and 108. A clear window 110 (FIG. 1) is provided near an edge of the sheet support surface 16 for viewing a portion of the belt 100. When a user rotates the knob 48 to adjust the binding apparatus 10 for a particular binder size, the belt 100 moves as well. The belt 100 is calibrated and positioned to reveal a label through the window corresponding to the particular binder diameter size at which the knob 48 is set.

The binding apparatus 10 may additionally include a motorized actuator (not shown) for adjusting the bar travel to accommodate a selected binder size. In such an embodiment, the motorized actuator could be provided in combination with the manual system described above. Alternatively, such a motorized embodiment could conveniently avoid the need for manual adjustment, and thus, the knob 48 could be eliminated. More specifically, an electric motor would be actuated by the user to adjust the binding apparatus, thereby moving the belt 100 to display the selected binder size setting. The embodiment could further include an actuating switch wherein the user turns the switch to select an indicated binder size, thereby actuating the motor to automatically adjust the binding apparatus 10 to accommodate that binder size.

The described embodiment wherein the first former bar 30 extends a predetermined distance f is reliable and requires a relatively simple actuating mechanism 52. The adjustability of the second former bar 32 mounted to the door 18 eliminates a need to variably limit the distance that the actuating mechanism can drive the first former bar 30. However, it should be recognized that other embodiments could include other means for closing the binder. For example, the actuator mechanism 52 could be adjustable to variably limit its displacement distance f. The displacement adjustment could be mechanical or electronically controlled, such as by a sensor operable to stop or reverse the actuator upon sensing a particular former bar position or amount of binder deflection. Additionally, a manual-control embodiment is possible, wherein a user actuates displacement of the first former bar 30 relative to the second former bar 32 until the binder 22 is properly closed. An alternative embodiment provides for linear movement of the door, whereby the second former is moved toward the first former to close the wire binder. In such an embodiment, an actuating mechanism moves the pivot point of the door during the closing operation. The first former bar could be static in such a system.

In any case, when the binder 22 has been deflected to a closed position, as illustrated, for example, in FIG. 5, the first former bar 30 may be retracted, freeing the closed wire binder 22, with its bound stack of sheets, for removal from the binding apparatus 10. In the embodiment wherein the actuating mechanism 52 includes a rotating eccentric cam 52*a*, the first former bar 30 is displaced by the distance f when the cam reaches its top-dead-center angle, thus subsequently beginning to retract automatically. When the closed binder 22 is released from compression between the first and second former bars 30, 32, the door 18 can be opened.

It has been found that sometimes the hooks 40 become disengaged from the wire binder 22 during the closing process. If this is the case, the wire binder 22 will typically fall away when the first former bar 30 is retracted, so long as the weight of the bound materials is sufficient to overcome the magnetic force of the magnetic former bar 30. If the hooks 40 remain engaged on the binder 22, the user simply lifts the binder 22 from the hooks 40 after retracting the first former bar 30 and opening the door 18.

While the invention is described herein in connection with certain preferred embodiments, there is no intent to limit it to those embodiments. On the contrary, it is recognized that various changes and modifications to the described embodiments will be apparent to those skilled in the art, and that such changes and modifications may be made without departing from the spirit and scope of the present invention. Accordingly, the intent is to cover all alternatives, modifications, and equivalents included within the spirit and scope of the invention as defined by the appended claims.

What is claimed is:

1. A binding apparatus for moving a wire binder between a binder open position and a binder closed position to bind a stack of perforated sheets, the wire binder having a plurality of wire ringlets, each of the wire ringlets including a spine end and an opposite free end, the binding apparatus comprising:

a fixed base;

a first former bar mounted to the base;

a former door pivotably mounted for movement between a door open position and a door closed position, the door open position providing access for placement of the wire binder in the binder open position against the first former bar, the door generally covering the first former bar in the door closed position;

a second former bar mounted to the door, the second former bar being disposed parallel to and spaced from the first former bar when the door is in the door closed position; and a third former bar mounted to the door substantially perpendicularly to the second former, such that the wire binder is disposed between the first and second former bars and the spine ends and free ends contact the third former bar when the door is in the door closed position;

at least one of the first former and second former bars being movable toward the other of said first or second former bar whereby the first and second former bars squeeze the wire binder from a binder open position to a binder closed position, the third former bar slidably guiding the spine ends and free ends of the wire ringlets as the first and second former bars move toward each other.

2. The binding apparatus of claim 1, wherein the door is pivotably mounted to the base at a pivot point which is movable whereby the space between the first and second former bars is variable.

3. The binding apparatus according to claim 2, wherein the door includes a pair of pivots which pivotally reside in respective slots in the base, the pivots being moveable within the respective slots.

4. The binding apparatus of claim 1, further comprising an actuating mechanism to drive the first former bar toward the second former bar.

5. The binding apparatus of claim 4, wherein the actuating mechanism includes a carriage which is slidably mounted to the base, the first former bar mounted to the carriage, and an actuator operable to drive the carriage a predetermined distance toward the second former bar.

6. The binding apparatus of claim 5, wherein the first former bar has a side, the binding apparatus further comprising a plurality of hooks adapted to receive said spine ends, said hooks being coupled to the carriage and projecting from the base along said side of the first former bar.

7. The binding apparatus of claim 6, further comprising a plate which is slidably mounted to the carriage for movement in a direction generally perpendicular to the first former bar, the hooks being mounted to the plate.

8. The binding apparatus of claim 7, further comprising at least one spring urging the plate toward a predetermined position relative to the carriage.

9. The binding apparatus of claim 8, further comprising a magnet mounted to exert a magnetic force to secure the sliding plate in the predetermined position until a force on the hooks overcomes the magnetic force.

10. The binding apparatus of claim 6, wherein each of the hooks is made of a resilient material.

11. The binding apparatus of claim 5, wherein the actuator has an cam rotatably mounted to the base and acting upon the carriage, wherein rotation of the cam displaces the carriage linearly.

12. The binding apparatus of claim 4, further comprising a pair of switches located at respectively opposite sides of the base, wherein both of the switches must be held to operate the actuator mechanism.

13. The binding apparatus of claim 4, further comprising a doorlock device which secures the door in the closed position when the first former bar is actuated to move toward the second former bar.

14. The binding apparatus of claim 13, wherein the doorlock device includes a pair of slots disposed within side panels of the door and a pair of movable latches that extend from sides of the base to engage within the respective slots upon actuation of the first former bar.

15. The binding apparatus of claim 14, wherein the each of the slots has an elongate shape.

16. The binding apparatus according to claim 1, wherein the first former bar is magnetic.

17. A binding apparatus operable to hold an open binder for receiving in a held position a stack of perforated sheets, and then to close the binder while the binder is in said held position, the binder having a plurality of wire ringlets, each of the ringlets having a spine end and a free end, the apparatus comprising:

a base having a sheet support surface with an upper edge;

a first former member mounted to the base generally along said upper edge of the sheet support surface, the first former member having an upper edge;

a plurality of hooks positioned along the upper edge of the first former member to hold the binder in said held position; and a door pivotably mounted to the base and which is movable between an open position and a closed position, wherein the hooks are accessible for mounting an open binder and loading a stack of sheets on the open binder when the door is in the open position, the door including a second former bar positioned to oppose the first former bar in a spaced manner when the door is in said closed position and a third former bar mounted substantially perpendicularly to the second former bar such that the third former bar contacts against free ends the ringlets when the door is in the closed position;

wherein at least one of the first and second former bars is moveable relative to the other said first or second former bars to close the wire binder therebetween.

18. The binding apparatus of claim 17, wherein the door is pivotably mounted to the base at a pivot point, said pivot point being adjustable to accommodate the binder of a selected size between the first and second former bars.

19. The binding apparatus according to claim 18, wherein the door includes a pair of pivots which pivotally reside in respective slots in the base, the pivots being moveable within the respective slots.

20. The binding apparatus of claim 17, further comprising an actuating mechanism to drive the first former bar toward the second former bar.

21. The binding apparatus of claim 20, wherein the actuating mechanism includes a carriage which is slidably mounted to the base, the first former bar mounted to the carriage, and a an actuator mechanism operable to drive the carriage a predetermined distance toward the second former bar.

22. The binding apparatus of claim 21, further comprising a plate a plate which is slidably mounted to the carriage for movement in a direction generally perpendicular to the first former bar, the hooks being mounted to the plate.

23. The binding apparatus of claim 22, further comprising at least one spring urging the plate toward a predetermined position relative to the carriage.

24. The binding apparatus of claim 23, further comprising a magnet mounted to exert a magnetic force to secure the sliding plate in the predetermined position until a force on the hooks overcomes the magnetic force.

25. The binding apparatus of claim 20, wherein the actuating mechanism includes an eccentric cam rotatably mounted to the base and acting upon the carriage, wherein rotation of the cam linearly displaces the carriage.

26. The binding apparatus of claim 17, further comprising a pair of switches located at respectively opposite sides of the base, wherein both of the switches must be held to operate the actuator mechanism.

27. The binding apparatus of claim 17, further comprising a doorlock device which secures the door in the closed position when the first and second bars are moved toward each other.

28. The binding apparatus of claim 27, wherein the doorlock device includes a pair of slots disposed within side panels of the door and a pair of movable latches that extend from sides of the base to engage within the respective slots upon actuation of the first former bar.

29. The binding apparatus of claim 28, wherein the each of the slots has an elongate shape to receive the latches within a range of adjusted door positions.

30. A method for binding a stack of sheets with a wire binder, the wire binder including a plurality of spaced ringlets, each of the ringlets having a spine end and an opposite free end, the spine ends connecting together adjacent ringlets, the method comprising the steps of:

providing a binding apparatus having a base defining a sheet support surface, a plurality of hooks mounted to the base, a door pivotably mounted to the base, first, second and third former bars, the second and third former bars being mounted to the former door and the first former bar being movably mounted to the base;

opening the door to provide access to the hooks;

providing the wire binder in an open condition;

hanging the spine ends of the ringlets on the hooks in a position whereby the ringlets rest upon the first former bar;

placing the stack of perforated sheets onto the binding element;

closing the door to a closed position with the second former substantially parallel to and spaced from the first former bar; and moving at least one of the first and second former bars toward the other said first or second former bar to squeeze the binding elements between the first and second former bars, thereby deflecting the ringlets of the wire binder to a closed condition.

31. The method of claim 30, wherein the step of closing the door includes:

contacting the third former bar against the free ends of the ringlets; and rolling the wire binder on the first former bar until the third former contacts the spine ends, to position the wire binder between the first and second former bars.

32. The method of claim 30, wherein the moving step includes guiding the spine ends and free ends of the ringlets to slide along the third former bar as the first and second former bars move toward each other.

33. The method of claim 30, further comprising adjusting an initial spacing between the second and third former bars to accommodate a selected binder size.

34. The method of claim 33, wherein the adjusting step includes moving a pivot point of the door relative to the base.

35. The method of claim 30, wherein the moving step includes driving the first former bar to project from the sheet support surface.

36. The method of claim 35, wherein the moving step further includes rotating an eccentric cam linked to linearly drive the first former bar.

37. The method of claim 30, further comprising locking the hooks in a predetermined position while the door is open.

38. The method of claim 36, further comprising releasing the locking upon closure of the door to release the hooks.

39. The method according to claim 30, further comprising:

holding the hooks with a magnetic force in a predetermined position; and displacing the hooks against a spring bias when a tension force on the hooks exceeds the magnetic force.

* * * * *

UNITED STATES PATENT AND TRADEMARK OFFICE

CERTIFICATE OF CORRECTION

PATENT NO. : 6,773,216 B2
DATED : August 10, 2004
INVENTOR(S) : Crudo et al.

It is certified that error appears in the above-identified patent and that said Letters Patent is hereby corrected as shown below:

Column 3,
Line 17, "Some prior art binding system required" should read -- Some prior art binding systems required --.

Column 12,
Line 36, "between the second and third former bars" should read -- between the first and second former bars --
Line 49, "The method of claim 36" should read -- The method of claim 37 --.

Signed and Sealed this

Thirtieth Day of November, 2004

JON W. DUDAS
*Director of the United States Patent and Trademark Office*